US007645182B2

(12) United States Patent
Abe et al.

(10) Patent No.: US 7,645,182 B2
(45) Date of Patent: Jan. 12, 2010

(54) APPARATUS AND METHOD FOR LAPPING SLIDER USING FLOATING LAPPING HEAD

(75) Inventors: Kiyohiko Abe, Hong Kong (CN); Masashi Kobayashi, Hong Kong (CN); Hiroyasu Tsuchiya, Hong Kong (CN); Santoso Tan, Hong Kong (CN); Zhong Xian Wei, Hong Kong (CN); Chun Hua Zhang, Hong Kong (CN); Fa Hong Li, Hong Kong (CN); Ming Yuan Chen, Hong Kong (CN)

(73) Assignee: Sae Magnetics (H.K.) Ltd., Hong Kong (CN)

( * ) Notice: Subject to any disclaimer, the term of this patent is extended or adjusted under 35 U.S.C. 154(b) by 0 days.

(21) Appl. No.: 12/076,840

(22) Filed: Mar. 24, 2008

(65) Prior Publication Data

US 2008/0242203 A1 Oct. 2, 2008

(30) Foreign Application Priority Data

Mar. 26, 2007 (JP) ..... 2007-078685

(51) Int. Cl.
*B24B 49/00* (2006.01)
*B24B 51/00* (2006.01)

(52) U.S. Cl. ..... 451/8; 29/603.09; 29/603.16; 451/41; 451/278

(58) Field of Classification Search ..... 29/603.1, 29/603.01, 603.07, 603.09, 603.16; 451/5, 451/8, 11, 36, 41, 259, 398
See application file for complete search history.

(56) References Cited

U.S. PATENT DOCUMENTS 6,991,513 B2 * 1/2006 Tohta et al. ..... 451/5
7,096,567 B2 * 8/2006 Shindo et al. ..... 29/603.12

FOREIGN PATENT DOCUMENTS

JP 10-249715 9/1998
JP 2002-157723 5/2002

* cited by examiner

*Primary Examiner*—Timothy V Eley
(74) *Attorney, Agent, or Firm*—Nixon & Vanderhye P.C.

(57) ABSTRACT

An apparatus for lapping a slider comprises a lapping head for supporting elements while pressing the elements against a rotating lapping plate, the elements that are to be formed into sliders, a holding mechanism for supporting the lapping head, the holding mechanism having a first engaging member that extends in a vertical direction, a base for supporting the holding mechanism, the base having a second engaging member that extends in the vertical direction, wherein the second engaging member is engaged with the first engaging member to form an internal space therebetween, and a decompressing mechanism for decompressing the internal space. The holding mechanism is subjected to vertically upward force from the decompressed internal space in order to be movably supported by the base in the vertical direction.

11 Claims, 7 Drawing Sheets

APPARATUS AND METHOD FOR LAPPING SLIDER USING FLOATING LAPPING HEAD

The present application is based on, and claims priority from, J.P. Application No. 2007-78685, filed on Mar. 26, 2007, the disclosure of which is hereby incorporated by reference herein in its entirety.

BACKGROUND OF THE INVENTION

1. Field of the Invention

The present invention relates to an apparatus and a method for lapping a slider, and more particularly relates to an apparatus and a method for lapping a slider which is used in a surface finishing lapping process that is performed after an element height forming lapping process.

2. Description of the Related Art

Sliders used in hard disk drives are fabricated through a wafer process in which read elements and write elements are formed, a process for dicing the wafer into blocks or bars, a lapping process for forming a predetermined air bearing surface, and so on. The lapping process usually consists of two or three separate lapping processes.

First, a rough lapping process, which is may be omitted, is performed in order to improve efficiency in the subsequent element height forming lapping process. In this rough lapping process, a block or a bar having a number of elements that are to be formed into sliders (hereinafter, simply referred to as "elements") formed thereon is lapped until the read element height reaches a target value thereof. The term "read element height" as used herein means a length (depth) of a read element measured in a direction that is perpendicular to the air bearing surface of an MR (Magneto Resistive) element, and the read element height plays an important role to achieve preferable properties, such as an MR ratio.

Next, in order to accurately form the read element height, a second lapping process called an element height forming lapping process is performed. This lapping process is also called a height adjustment lapping process. Accurate formation of the read element height is significantly important, and a lapping method using resistance elements, such as RLG (Resistance Lapping Guide), is known. The resistance elements are formed in advance between the MR elements in a wafer process, and each resistance element is electrically connected at both ends thereof to pads, which are formed on a surface of a bar that is other than the lapping surface of the bar, via the inside of the elements. During lapping, electric resistance of the resistance elements is measured via the pads. The resistance elements are lapped together with the MR elements, and thereby the electric resistance of the resistance elements is increased as lapping progresses. Thus, it is possible to indirectly estimate the lapping amount of the elements during lapping by obtaining the relationship between an amount in which the elements are lapped and the electric resistance in advance and by lapping the elements while monitoring of the electric resistance of the resistance elements.

However, when a plurality of elements are simultaneously lapped using the above described method, it is not possible to completely prevent variation in the lapping amount among the elements during lapping. Recently, a technology has been disclosed to reduce the variation in the lapping amount during lapping by using a plurality of pressing cylinders for individual elements and thereby applying optimum pressing force to each element (see Japanese Patent Laid-Open Publication No. 2002-157723).

The final lapping process is a so-called surface finishing lapping process, and is often called a touch lap. In the surface finishing lapping process, a mirror finished lapping plate is used to lap the air bearing surface. The surface finishing lapping process removes scratches and the like on the air bearing surface so that smoothness of the air bearing surface can be improved. In this process, a convex shape called a crown is simultaneously formed on the air bearing surface, which is important for flying properties of a slider. In the surface finishing lapping process, the lapping amount itself is not monitored because the lapping amount is small and the pressing force is limited. Lapping is completed when a certain period of time of lapping lapses based on a lapping rate which has been estimated in advance. As means for applying pressing force, Japanese Patent Laid-Open Publication No. 2002-157723 discloses a method for applying optimum pressing force to each element by using a plurality of pressing cylinders, as in the element height forming lapping process. Also, a more simple method is disclosed in Japanese Patent Laid-Open Publication No. 249714/98, in which a weight is put on a lapping head that holds elements.

It is desirable that a lapping plate be as smooth as possible and be accurately mounted with regard to the horizontal direction, but actually the plate is slightly uneven. Therefore, the vertical position of the elements varies relative to the lapping plate during lapping according to the rotation of the lapping plate. If the lapping plate is not accurately mounted with regard to the horizontal direction, the vertical position of elements is also varied during lapping according to the rotation of the lapping plate. Specifically, when the elements pass over a convex portion of the lapping plate, the elements are subjected to increased upward force (thrust) from the lapping plate, leading to an increase in the pressing force against the elements. In a conventional lapping method in which a plurality of elements in a bar are simultaneously lapped, the change in the pressing force may cause variation in the average pressing force among elements in a bar. Moreover, since the surface condition of a lapping plate continuously changes during lapping, the average pressing force also varies among bars. However, it is significantly difficult to keep a lapping plate in a flat and constant condition all the time.

If the average pressing force varies, then elements subjected to large pressing force may be damaged in the worst case. Moreover, since the surface finishing lapping process actually generates a certain amount of lapping, the variation in the element heights that is minimized in the previous element height forming lapping process may be increased again. According to the investigation conducted by the inventors of the present invention, the variation in the element height (MR height) after the surface finishing lapping process is larger than the variation after the element height forming lapping process by about 3 nm. An increase in the recording density of a magnetic head in the future requires a reduction in the element height, and therefore, an increase in the variation in the element height in the surface finishing lapping process makes it difficult to achieve higher recording density of a magnetic head. Variation in the average pressing force may also increase variation in the magnitude of recessions near the read and write element, i.e., PTR (Pole Tip Recession). For example, if a read element is retracted from the air bearing surface relative to the substrate made of $Al_2O_3$/TiC, then the distance from a recording medium is increased, and desired reading property is lost. Therefore, large variation in the PRT also leads to a degradation of yield.

Furthermore, if the average pressing force varies, then the lapping plate itself is conversely subjected to large reaction force from the elements at locations of the plate (the concave portions) where large pressing force is applied to the elements. The reaction force may cause fine scratches on the plate, which may reduce the lifetime of the plate because the surface finishing lapping process requires a highly precise mirror finished plate.

SUMMARY OF THE INVENTION

An object of the present invention is to provide an apparatus and a method for lapping a slider that enables a reduction in the variation of lapping amount of the elements in the surface finishing lapping process that is performed after the element height forming lapping process.

According to an embodiment of the present invention, an apparatus for lapping a slider comprises a lapping head for supporting elements while pressing the elements against a rotating lapping plate, the elements that are to be formed into sliders, a holding mechanism for supporting the lapping head, the holding mechanism having a first engaging member that extends in a vertical direction, a base for supporting the holding mechanism, the base having a second engaging member that extends in the vertical direction, wherein the second engaging member is engaged with the first engaging member to form an internal space therebetween, and a decompressing mechanism for decompressing the internal space. The holding mechanism is subjected to vertically upward force from the decompressed internal space in order to be movably supported by the base in the vertical direction.

In an apparatus for lapping a slider thus configured, reaction force, which is applied to the elements that are to be formed into sliders from the lapping plate during lapping, is transferred to the holding mechanism via the lapping head. As described above, a lapping plate has fine irregularities on the surface, and the vertical position of the elements varies in response to the rotation of the lapping plate. Specifically, when an element moves from a concave portion to a convex portion of the lapping plate, the vertical position of the elements is raised in accordance with this movement. However, the first engaging member of the holding mechanism is raised relative to the second engaging member in response to the upward movement of the elements, and the increased reaction force that is applied to the elements from the lapping plate is absorbed in the internal space which is formed between the first engaging member and the second engaging member, and accordingly, an increase in the reaction force is limited. Then, when the elements move from the convex portion to a concave portion again, the first engaging member is stopped at the raised position because of the friction between the first engaging member and the second engaging member. If the elements then move to a higher convex portion, the first engaging member is raised similarly. In this way, the vertical position of the first engaging member is gradually raised as the element passes over convex portions of the lapping plate, and is modified to an optimum position in a self controlled manner. Because the movement of the first engaging member is significantly small, there is little change in the pressure of the internal space. Therefore, the movement is not disturbed by the increased pressure of the internal space. Moreover, since the movement of the first engaging member is significantly small, change in the pressing force with which the elements are pressed against the lapping plate is minimized.

As explained above, according to the present invention, it is possible to provide an apparatus and a method for lapping a slider that enables a reduction in the variation of lapping amount of the elements in a surface finishing lapping process that is performed after an element height forming lapping process.

The above and other objects, features and advantages of the present invention will become apparent from the following description with reference to the accompanying drawings which illustrate examples of the present invention.

DETAILED DESCRIPTION OF THE PREFERRED EMBODIMENTS

Next, an apparatus and a method for lapping a slider according to an embodiment of the present invention will be explained in detail with reference to the drawings.

Figure 1:
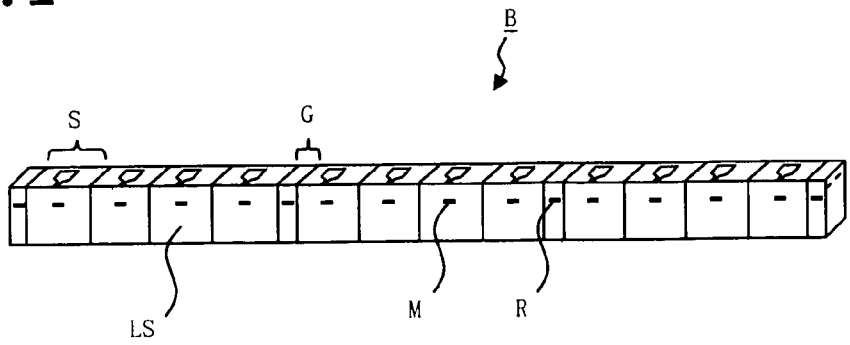
FIG. 1 is a perspective view showing a bar having a number of elements that are to be formed into sliders formed thereon.

First, explanation will be made about elements that are to be lapped in accordance with the present embodiment. FIG. 1 is a perspective view showing a bar having a number of elements that are to be formed into sliders formed thereon. Bar B is fabricated by dicing a wafer to separate a part of elements S formed thereon. Each element S includes MR element M, which is a read element. MR elements M are positioned on the air bearing surface and are lapped with a predetermined element height. Therefore, the air bearing surface on which MR elements M are formed corresponds to lapping surface LS of bar B. Elements S are arranged in a line and gap G is formed between adjacent elements S. Gap G is provided with RLG element R that faces lapping surface LS. RLG element may have the same film structure as MR element M, and may be fabricated simultaneously with MR elements in the wafer process. RLG element is electrically connected to pads (not shown), which are provided on a surface other than lapping surface LS, at both ends thereof. In FIG. 1, gap G is formed between a set of elements S in which elements S are arranged in series and another set of elements S in which elements S are arranged in series, but may be formed between every pair of adjacent elements S. A dicing margin (not shown) provided between every pair of adjacent elements S may be used as gap G. Although bar B is the object of lapping in this embodiment, it should be noted that a wafer may be separated into several blocks first, and then each block may be separated into bars B. In this case, the block may be the object of lapping.

Figure 2:
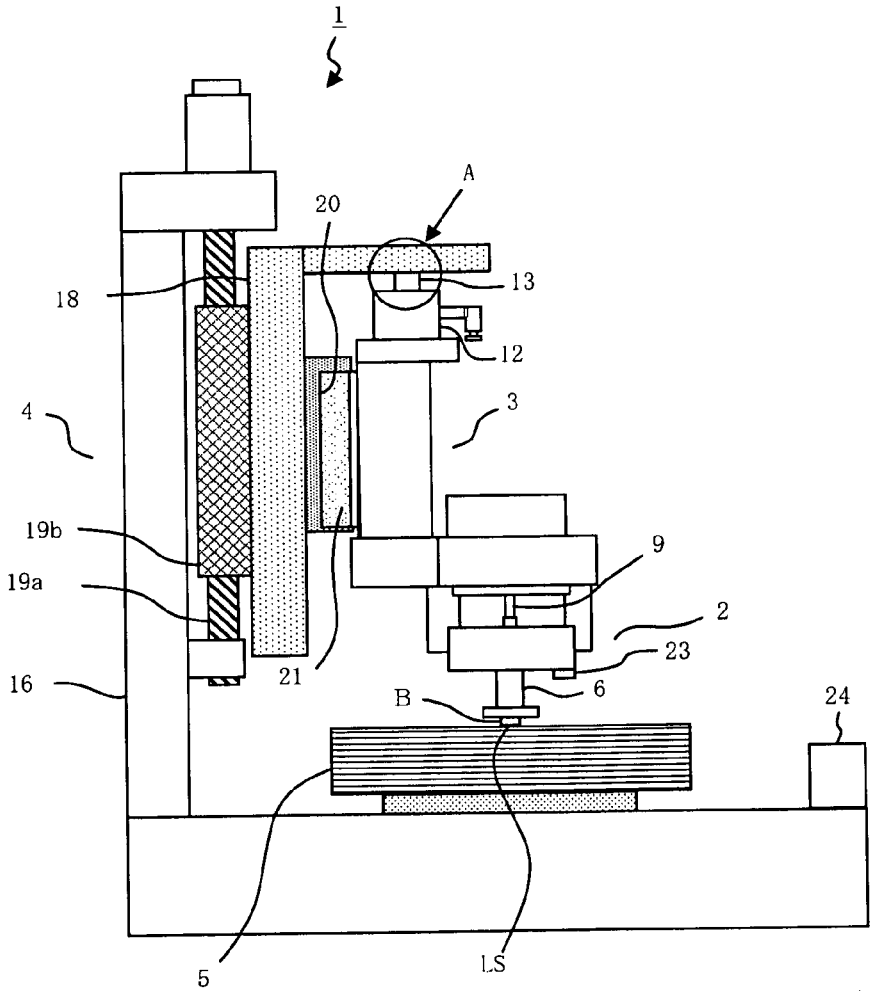
FIG. 2 is a conceptual view showing an apparatus for lapping a slider according to an embodiment of the present invention.

FIG. 2 is a conceptual view showing an apparatus for lapping a slider according to an embodiment of the present invention. This lapping apparatus can be used in the surface finishing lapping process that constitutes the slider lapping process described above, but may be used in the element height forming lapping process or in the other lapping process.

Slider lapping apparatus 1 includes lapping head 2, holding mechanism 3 for supporting lapping head 2, and base 4 for supporting holding mechanism 3. Base 4 has rotatable lapping plate 5 mounted thereon. Lapping head 2 is adapted to hold bar B such that lapping surface LS faces lapping plate 5. Bar B is pressed against rotating lapping plate 5 in order to be lapped. In FIG. 2, the longitudinal direction of bar B extends perpendicularly to the drawing.

Figure 3:
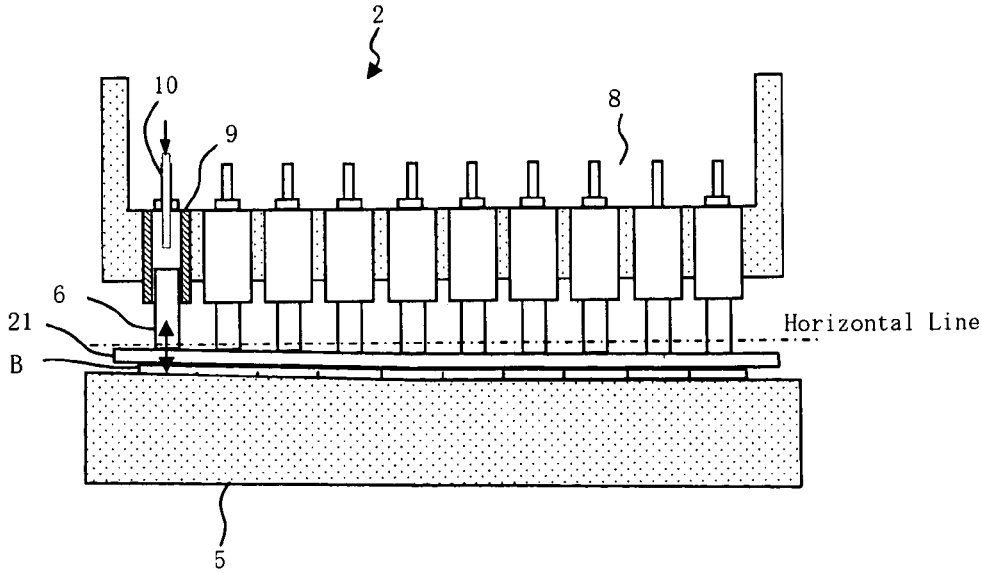
FIG. 3 is a conceptual view showing the structure of a lapping head.

FIG. 3 is a conceptual view showing the structure of the lapping head. In FIG. 3, the longitudinal direction of bar B extends from right to left in the drawing. Lapping head 2 has a plurality of cylindrical pushers 6 to press bars B against lapping plate 5 via rubber sheet G. Pushers 6 are positioned right above the positions of respective elements S. Pusher supporting section 8 has cylinders 9 to receive pushers 6. Air is supplied to cylinders 9 via air pipes 10. In FIG. 3, the leftmost pusher 6 and cylinder 9 are shown in section. Control of air pressure in cylinder 9 allows pushers 6 to move in the vertical direction, and the vertical movement of pushers 6, in turn, enables individual control of pressing force of each pusher 6 against lapping plate 5. FIG. 3, which emphasizes the deformation of lapping plate 5 in the radial direction, shows the state in which upward deformation of lapping plate 5 is increased toward the left side in the drawing. In this case, the length of the portion of pusher 6 that protrudes out of cylinder 9, i.e., the protruding length, is decreased toward the left side and is increased toward the right side. Pushers 6 are movable relative to pusher supporting section 8, but pusher supporting section 8 is mounted to holding mechanism 3 and is fixed at least in the vertical direction.

Figure 4:
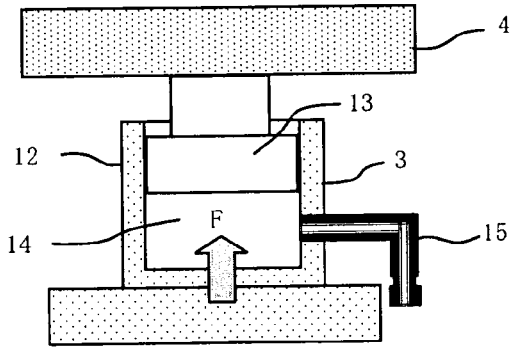
FIG. 4 is a schematic enlarged cross sectional view of portion A in FIG. 2 showing a coupling structure between the holding mechanism and the base.

Referring to FIG. 2, holding mechanism 3 supports lapping head 2, and also cooperates with base 4 to correct the vertical position of lapping head 2 in a self controlled manner in accordance with the uneven surface condition of lapping plate 5. FIG. 4 is a schematic enlarged cross sectional view of portion A in FIG. 2, showing a coupling structure between the holding mechanism and the base. Holding mechanism 3 has cylinder 12 (first engaging member) at the upper end thereof. Cylinder 12 extends in the vertical direction and is open at the upper end thereof. Base 4 has piston 13 (second engaging member) that faces cylinder 12 and that extends in the vertical direction. Piston 13 is fitted into cylinder 12. However, piston 13 does not reach the lower end of cylinder 12 so that internal space 14 is formed by piston 13 and cylinder 12. Internal space 14 is connected to one end of air tube 15, and the other end of air tube 15 is connected to a vacuum pump (not shown). Air tube 15 and the vacuum pump form a decompressing mechanism to decompress internal space 14 (to form negative pressure in internal space 14) relative to the atmospheric pressure.

When internal space 14 is decompressed, holding mechanism 3 is subjected to upward force F in the vertical direction from the decompressed internal space 14. The magnitude of force F depends on the degree of decompression (the degree of vacuum), but is preferably a magnitude by which the weight of holding mechanism 3 and lapping head 2 connected to holding mechanism 3 can be substantially canceled. Because of the static friction between piston 13 and cylinder 12 and the static friction between groove 20 of base 4 and projection 21 of holding mechanism 3, which will be explained later, cylinder 12 is maintained in a stationary state relative to piston 13. In this state, holding mechanism 3 and lapping head 2 are, so to speak, put in a floating state, in which holding mechanism 3 and lapping head 2 are highly sensitive to any vertical external force so that they can move and stop in the vertical direction in response to the external force. Holding mechanism 3 and lapping head 2 are supported by base 4 in this manner.

Figure 5:
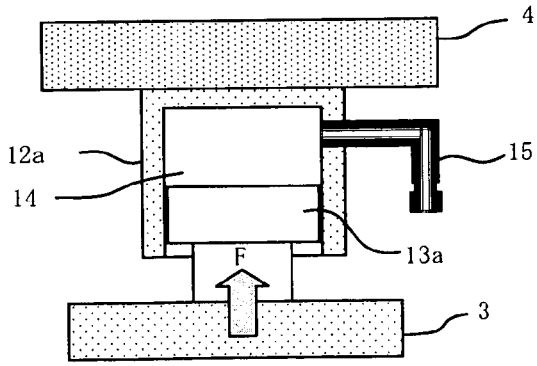
FIG. 5 is a schematic enlarged cross sectional view of portion A in FIG. 2 showing another coupling structure between the holding mechanism and the base.

In the above embodiment, holding mechanism 3 has cylinder 12, and base 4 has piston 13. However, holding mechanism 3 may have piston 13*a*, and base 4 may have cylinder 12*a*, as shown in FIG. 5. Further, since no force F is generated when internal space 14 is not decompressed, a stopper (not shown) is desirably provided to help base 4 to support holding mechanism 3 in a non-decompressed state. The stopper may be provided at the engaging portion between cylinder 12 and piston 13, or may be provided between groove 20 of base 4 and projection 21 of holding mechanism 3.

Referring again to FIG. 2, base 4 has fixed frame member 16 to support lapping plate 5 and guide member 18 which is movable in the vertical direction relative to frame member 16. Piston (second engaging member) 13 described above is mounted to guide member 18. Frame member 16 and guide member 18 are coupled to each other by means of ball screw 19*a* mounted to frame member 16 and nut 19*b* that is mounted to guide member 18 for engagement with ball screw 19*a*. The configuration in which guide member 18 is movable in the vertical direction relative to frame member 16 is useful, for example, when a space is required between lapping head 2 and plate 5 in order to mount bar B to lapping head 2. The coupling structure between frame member 16 and guide member 18 is not limited to the combination of ball screw 19*a* and nut 19*b* as long as guide member 18 is supported movably in the vertical direction relative to frame member 16. Any structures, such as combination of a rack and a pinion, a linear motor and so on, may be used.

Guide section 18 has vertically extending groove 20 (first engaging section). Holding mechanism 3 has projection 21 (second engaging section) that extends vertically and that is engaged with groove 20. If holding mechanism 3 moves in a direction that is other than the vertical direction during lapping, then lapping head 2 that is mounted to holding mechanism 3 may be inclined, and, for example, bar B that is mounted to lapping head 2 may disadvantageously contact lapping plate 5 at one side thereof. Holding mechanism 3, which is only movable in the vertical direction relative to guide member 18 due to the cooperation between groove 20 and projection 21, prevents such a problem. The same effect can also be obtained by the structure in which guide member 18 has projection 21 and holding mechanism 3 has groove 20. It should be noted that fitting between groove 20 and projection 21 should be appropriately adjusted in order to prevent any movement in a direction other than the vertical direction. If static friction between groove 20 and projection 21 is too large, then smooth movement of holding mechanism 3 relative to guide member 18 may be disturbed. Therefore, a surface treatment may be performed to reduce the friction.

Lapping apparatus 1 further includes distance detecting apparatus 23 to detect a distance between pusher supporting section 8 and lapping plate 5. Distance detecting apparatus 23 may be, for example, a sensor using infrared rays. Distance detecting apparatus 23 is operated when holding mechanism 3 and lapping head 2 to which bar B is mounted move toward lapping plate 5 by rotation of ball screw 19*a*.

Lapping plate 5 is formed of tin (Sn) and includes diamond abrasive grains embedded therein. Lapping plate 5 has a rotation shaft (not shown) so that lapping plate 5 is rotated by means of a motor (not shown). Lapping plate 5 has a slightly concave shape directed upwardly in order to provide elements S with an appropriate crown shape. For example, lapping plate 5 has a curvature in the order of 5 m to 30 m.

Figure 6:
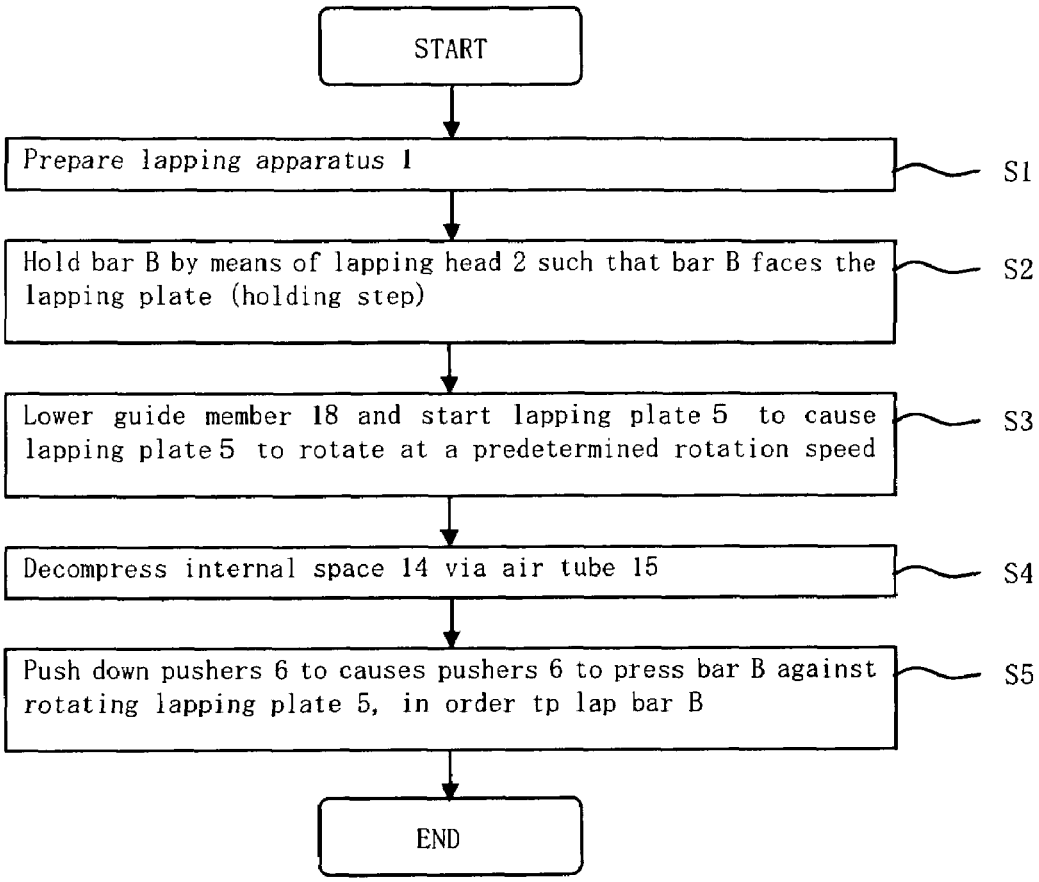
FIG. 6 is a flow chart showing a method for lapping a slider according to an embodiment of the present invention.

Next, a method for lapping a slider using lapping apparatus 1 explained above will be explained with reference to the flow chart in FIG. 6. In a typical method for manufacturing a slider, a number of elements are formed on a wafer in the wafer process, and after the back surface of the wafer is lapped (backside lapping), the wafer is diced into blocks or bars, which are subjected to the rough lapping process described above. Subsequently, the element height forming lapping process and the surface finishing lapping process are performed. A DLC (Diamond like Carbon) film is then coated on the air bearing surface to protect the same. The bar is separated into sliders and each slider is attached to a HGA (Head Stack Assembly). Since the present embodiment is characterized by the surface finishing lapping process, explanations on other processes are omitted. However, it should be noted that the lapping method of the present embodiment can also be applied to lapping processes other than the surface finishing lapping process.

(Step 1)

Figure 7:
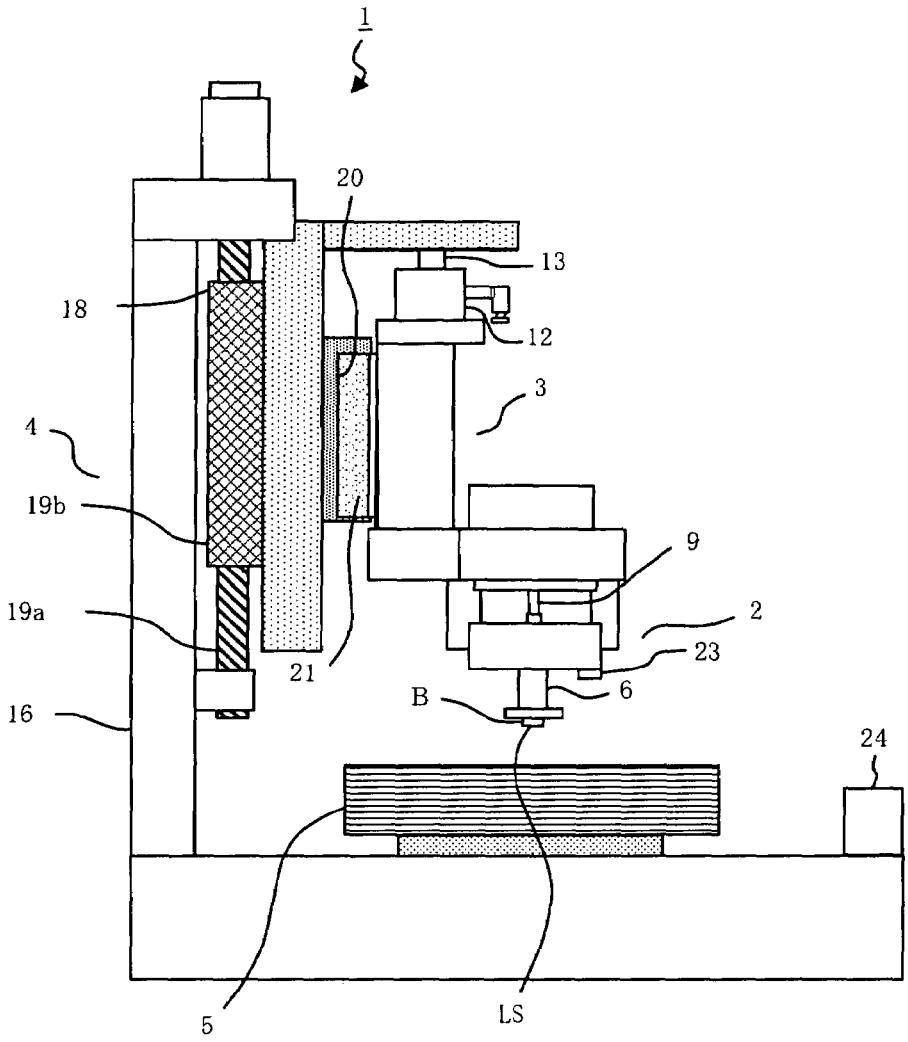
FIG. 7 is a conceptual view of a lapping apparatus in a state in which a bar is mounted to the lapping apparatus before the surface finishing lapping process is performed.

First, lapping apparatus 1 described above is prepared. FIG. 7 is a conceptual view of lapping apparatus 1 in a state in which bar B is mounted to lapping apparatus 1 before the surface finishing lapping process is performed. Cylinder 12 (first engaging member) and piston 13 (second engaging member) are engaged with each other in advance to form internal space 14. Guide section 18 is lifted upward by means of ball screw 19*a* so that a space is formed between lapping head 2 and lapping plate 5.

(Step 2)

Next, bar B is held by lapping head 2 such that bar B faces lapping plate (holding step). Bar B is mounted to lapping head 2 using the space that is generated between lapping head 2 and lapping plate 5 in the previous step, as mentioned above. Specifically, bar B is first mounted to lapping head 2 via rubber sheet G. Lapping head 2 is provided with a vacuum suction device (not shown) so that bar B is securely held by lapping head 2. Furthermore, probes or the like are attached to the pads that are provided in bar B, and preparation for detecting a change in electric resistance of RLG elements R during lapping is ready. The relationship between the lapping amount of RLG element R and the electric resistance thereof is estimated in advance.

(Step 3)

Next, ball screw 19*a* is rotated to lower guide member 18. Guide member 18 is stopped when distance detecting apparatus 23 detects a predetermined distance between pusher supporting section 8 and lapping plate 5. At this point, bar B is not in contact with lapping plate 5, but is located slightly above lapping plate 5. Next, lapping plate 5 is actuated and starts rotation at a predetermined rotational speed.

(Step 4)

Next, internal space 14 is decompressed via air tube 15. As a result of this, holding mechanism 3 is subjected to upward force F (see FIG. 4) in the vertical direction from internal space 14 that has been decompressed. By releasing the stopper described above, holding mechanism 3 is put in a floating state and is movably supported relative to base 4 in the vertical direction.

(Step 5)

Next, air is supplied into cylinders 9 via air pipes 10. The supplied air pushes pushers 6 down and thereby causes pushers 6 to press bar B against rotating lapping plate 5, and lapping of bar B is started. RLG elements R, which are provided adjacent to elements S on lapping surface LS, are lapped simultaneously with elements S, and the electric resistance of RLG elements R is continuously monitored during lapping. The height (unevenness) of lapping plate 5 at positions where lapping plate 5 contacts with elements S varies depending on the locations on lapping plate 5 in the radial direction because of the local unevenness of lapping plate 5 or the accuracy with which lapping plate 5 is mounted in the horizontal direction. As a result, the average pressing force applied to elements S varies among elements S. Since the average pressing force applied to each element S is generally proportional to the lapping amount of element S, the average pressing force applied to each element S can be estimated by detecting a change in electric resistance of RLG elements R. The air pressure in cylinders 9 is controlled in accordance with the average pressing force that is detected, so that strokes of pushers 6 can be individually controlled in the vertical direction. In this way, it is possible to lap bar B while controlling the pressing force at the location of each element S with which pusher 6 presses bar B against lapping plate 5. The lapping step is completed when the electric resistance of RLG elements R reaches a target value of the electric resistance which is predetermined based on the relationship between the lapping amount of RLG element R and the electric resistance of the same.

Figure 8:
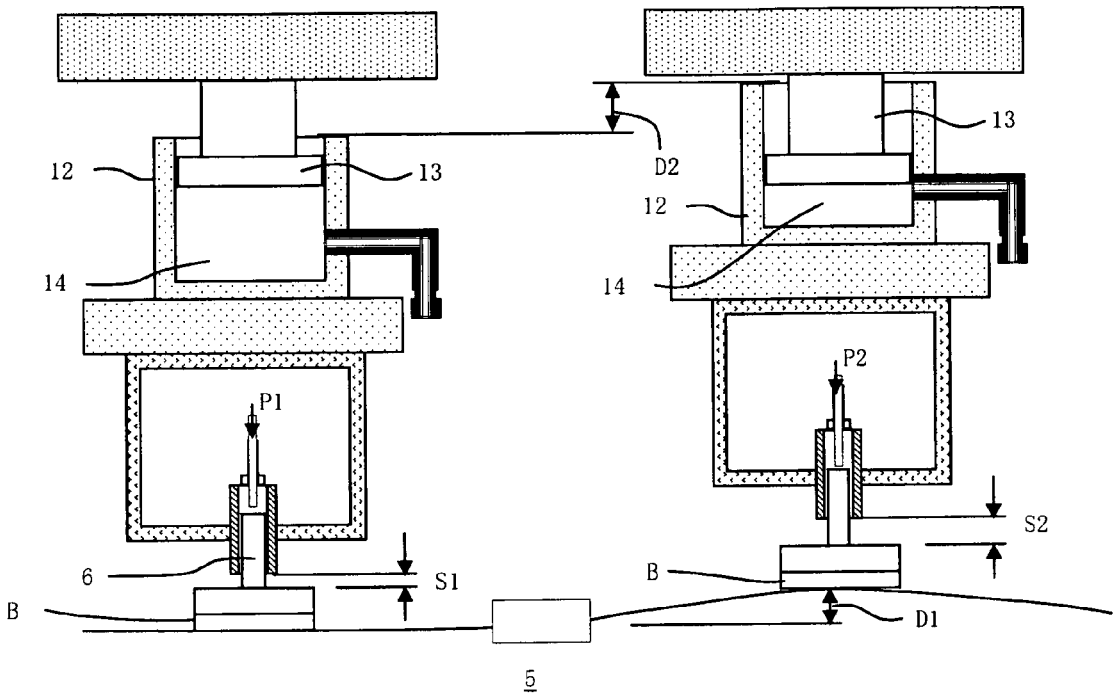
FIG. 8 is a conceptual view showing the effect of the present invention.

As described above, holding mechanism 3 is vertically supported by base 4 in a floating state. The effect obtained by this configuration will be explained with reference to FIG. 8. The left part shows a state in which the surface of lapping plate 5 is located at a relatively low elevation. The right part shows a state in which the surface of lapping plate 5 is located at a relatively high elevation. For illustrative purpose, the difference between the left and right parts is emphasized, but actually the difference is significantly small. When bar B is in a state of the left part, pusher 6 protrudes out of cylinder 9 by length S1, and the pressure in cylinder 9 is P1. The upper end of cylinder 12 is positioned near the lower end of piston 13. Since internal space 14 is at a negative pressure that cancels the weight of holding mechanism 3 and lapping head 2, holding mechanism 3 and lapping head 2 are substantially in a floating state.

Next, assume the state of the right part in which lapping plate 5 is further rotated and the surface level of lapping plate 5 is raised by height D1 at the position where lapping plate 5 contacts with bar B. Since bar B is raised by height D1, holding mechanism 3 and lapping head 2 are also raised by the same height D1. For convenience of illustration, assume that height D1 is constant in the longitudinal direction of bar B. Taking into consideration the fact that piston 13 is fixed to base 4 and is immobile, cylinder 12 is raised relative to piston 13 and internal space 14 is reduced in accordance with the vertical movement of cylinder 12. The height by which holding mechanism 3 and lapping head 2 are raised is not the same as height D1 because of various factors, such as inertia of holding mechanism 3 and lapping head 2 themselves, friction between cylinder 12 and piston 13, and friction between guide member 18 and projection 21. Usually, holding mechanism 3 and lapping head 2 are raised by height D2 that is larger than height D1 because of the inertia of holding mechanism 3 and lapping head 2 themselves. However, once holding mechanism 3 and lapping head 2 are raised and influence of the inertia disappears, the friction between cylinder 12 and piston 13 and the friction between guide member 18 and projection 21 become dominant, and holding mechanism 3 and lapping head 2 are stopped at the raised position. Since height D1 is actually on the order of nm, the increase in the pressure in internal space 14 is negligible. Therefore, holding mechanism 3 and lapping head 2 return to a balanced state again at the raised position and recover the floating state. In this way, reaction force (thrust) that is applied from lapping plate 5 against bar B when bar B passes over a convex portion of lapping plate 5 is absorbed, and thereby a rapid increase in the pressing force against bar B is limited. The variation in the pressing force is a major factor which causes variation in the lapping amount of elements S, and as a result, the variation in the lapping amount of elements S during lapping is reduced.

When lapping plate 5 is further rotated, and the surface height of lapping plate 5 comes to be less than height D1 at the position where lapping plate 5 contacts with bar B, bar B is not pushed upward by lapping plate 5. As a result, holding mechanism 3 and lapping head 2 are no more raised. Whereas, when the surface height of lapping plate 5 at the position where lapping plate 5 contacts with bar B becomes more than height D1, the movement described above is repeated. Usually, the upward movement of holding mechanism 3 and lapping head 2 is substantially completed when lapping plate 5 makes one revolution, and subsequent pushing motion against bar B is substantially prevented. According to the present embodiment, the elevation of bar B relative to lapping plate 5 is modified to an elevation at which pushing motion from lapping plate 5 can be narrowly prevented. Moreover, this movement occurs in a self controlled manner via the rotation of lapping plate 5. It should be noted that the surface condition of lapping plate 5 and bar B continuously change during lapping, and accordingly, the positional relationship between lapping plate 5 and bar B also changes continuously depending on the surface condition. Therefore, it is possible that holding mechanism 3 and lapping head 2 are raised again during lapping. However, this movement also occurs in a self controlled manner via the rotation of lapping plate 5, and bar 5 can be maintained at an optimum elevation relative to lapping plate 5 all through the lapping process.

Meanwhile, since holding mechanism 3 and lapping head 2 are usually raised, as described above, the pressing force applied from pushers 6 is decreased in accordance with the upward movement. However, the reduction in the pressing force is limited because the upward movement of holding mechanism 3 and lapping head 2 is on the order of several nm. The reduction in the pressing force is also mitigated because of the resiliency of rubber sheet 21 via which bar B is pressed against lapping plate 5 by pushers 6. As a result, variation in pressing force can be minimized.

In the present embodiment, the reduction in the pressing force can also be controlled because the protruding lengths of pushers 6 are individually controlled. A change in the pressing force causes a change in the lapping amount. The lapping amount of each element S can be estimated by monitoring the change in the electric resistance of RLG element R, as described above. In the present embodiment, the lapping amount of each element S can be individually controlled by adjusting the pressure of cylinder 9 located right above each element S and by adjusting the protruding length of pushers 6. In the right part of FIG. 8, since lapping head 2 is raised by height D2 that is larger than height D1, the pressure in cylinder 9 is increased to P2, and the protruding length of pusher 6 is increased to S2. Accordingly, the pressing force can be maintained at a certain magnitude before and after bar B passes over a convex portion. Moreover, since the pressing force can be adjusted for each element S, variation in the pressing force can be further reduced. It should be noted that the optimum positional relationship between bar B and lapping plate 5 may be broken by adjusting the protruding length of pusher 6. However, the positional relationship between bar B and lapping plate is automatically corrected to a new optimum positional relationship due toy the upward movement of holding mechanism 3 and lapping head 2, as described above.

Figure 9A:
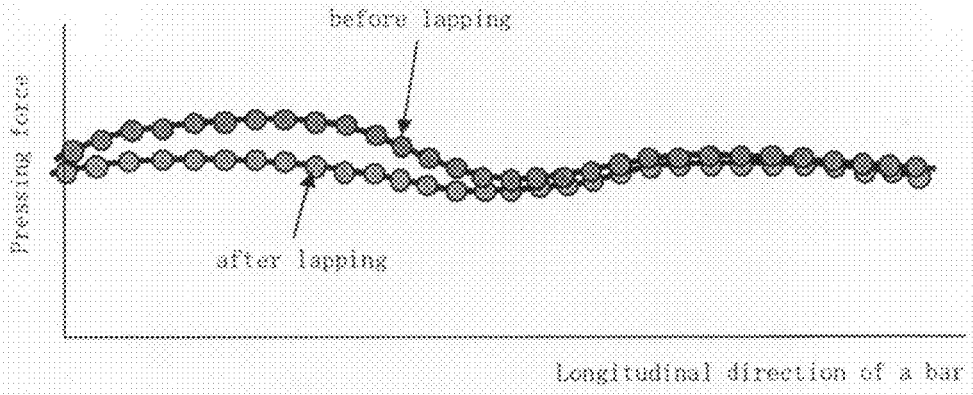
Fig.9A (Prior Art)
FIG. 9A is a conceptual diagram showing the pressing force of a pusher before and after lapping according to prior art.
Figure 9B:
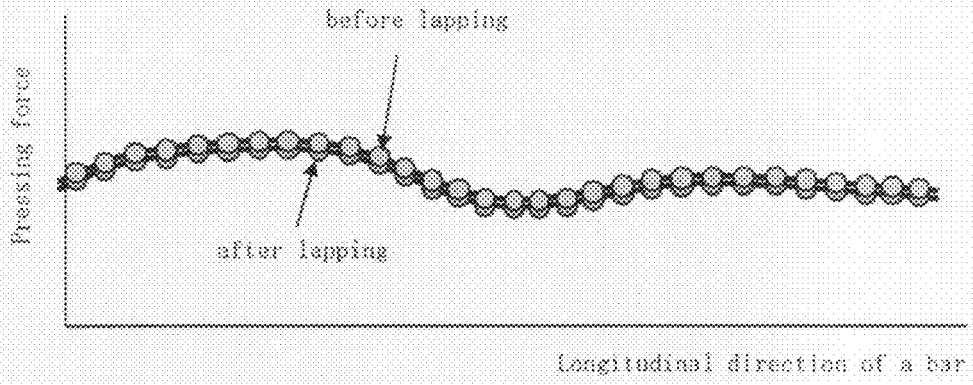
FIG. 9B is a conceptual diagram showing the pressing force of a pusher before and after lapping according to present embodiment.

FIGS. 9A and 9B are conceptual diagrams comparing the pressing force of a pusher according to the present embodiment and according to prior art. FIG. 9A shows the pressing force of a pusher before and after lapping according to prior art. The horizontal axis represents the longitudinal direction of a bar. In prior art, the position of a bar relative to a lapping plate is set before lapping, and is not changed during lapping. The pressing force after lapping is considerably reduced at some positions as compared to the pressing force before lapping. This means that the bar slightly floats from the lapping plate. This is because the bar is excessively lapped under strong pressing force during lapping. As a result, the bar is partially lapped in a large amount and partially lapped in a small amount. This implies that the element height that is uniformly formed in the element height forming lapping process varies in the surface finishing lapping process. In the surface finishing lapping process, it is important to keep variation in the element height as small as possible and thereby to uniformly lap a bar.

FIG. 9B shows pressing force of a pusher before and after lapping according to the present embodiment. In the present embodiment, since unevenness of a lapping plate is effectively absorbed, strong pressing force can be prevented during lapping. Therefore, the pressing force can be kept generally constant, although it is slightly reduced.

Figure 10A:
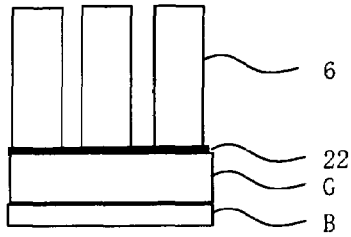
FIGS. 10A to 10C are schematic diagrams showing a bar, a pusher, a rubber sheet, etc. used in the example.
Figure 10B:
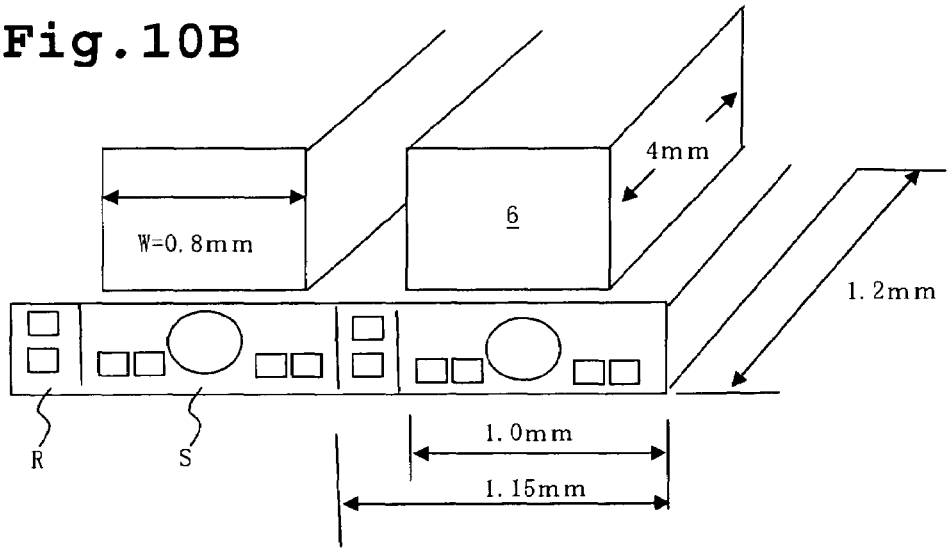
Figure 10C:
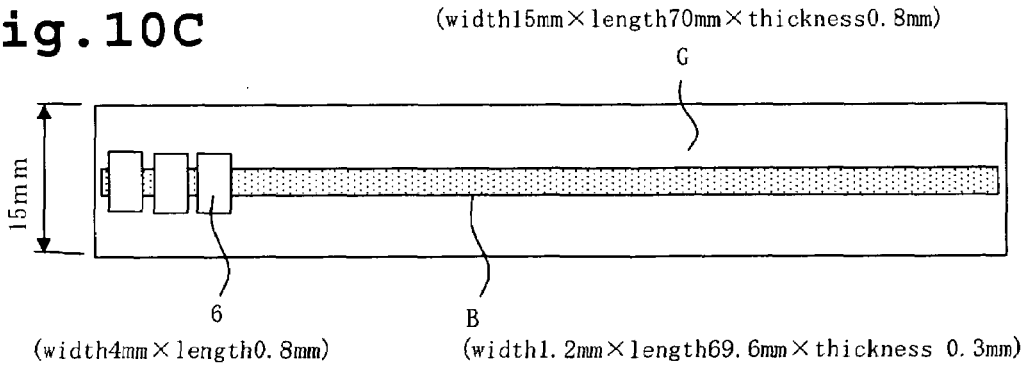

Finally, an example of the present invention will be described in order to show the effect of the present invention. By using TMR elements as a sample, the variation in the MR height, the variation in the PTR and the variation in the lifetime of a lapping plate were evaluated. FIGS. 10A to 10C are schematic diagrams showing a bar, a pusher, a rubber sheet, etc. used in the following example. FIG. 10A is a side view of the bar and the rubber sheet etc. FIG. 10B is a perspective view showing the relationship between the pusher and the bar. FIG. 10C is a top plan view of the bar and the rubber sheet etc. The bar has a length of 69.6 mm, a width of 1.2 mm, and a thickness of 0.3 mm. Each element has a length of 1.15 mm in the longitudinal direction of the bar, and a dicing margin having 0.15 mm width was provided between adjacent elements so that a RLG element was arranged in each dicing margin. The rubber sheet was formed of a polyether urethane based material. The rubber sheet preferably has a thickness of 0.7 to 0.9 mm, and a rubber sheet having a thickness of 0.8 mm was used. The rubber sheet has Hardness 14 (JIS Z0237). Double sided adhesive tape 22 was interposed between the pusher and the rubber sheet, as shown in FIG. 10A. The pushers were mounted right above the bar, as shown in FIG. 10B. A comparative example is the same as the present example except for the configuration of the present example in which holding mechanism 3 is vertically supported by base 4 in a floating state. The average pressing force of the pusher was 23 g (38 g in the comparative example), the average lapping amount was 30 nm (20 nm in the comparative example), and the lapping time was 120 seconds (60 seconds in the comparative example).

First, the difference in the MR height before and after lapping, i.e., the lapping amount in the surface finishing lapping process was evaluated using one hundred bars, and the variation in the lapping amount was evaluated. It was found that the variation in the MR height, which was 8 nm in the comparative example, was reduced to 3 nm in the example. Next, height of protrusion (PTR) near the read element and the write element with respect to the substrate made of $Al_2O_3$/TiC was measured after the surface finishing lapping process using an AFM (Atomic Force Microscope). One hundred bars were used and three elements per a bar were used for measurement. It was found that the height of the protrusion, which was 0.8 nm in the comparative example, was reduced to 0.5 nm in the present example. Then, the lifetime of the lapping plate was evaluated. In this evaluation, the lapping plate was assumed to exceed the life span when the lapping rate reaches 5 nm/minutes. It was found that 40 bars were lapped before the lapping plate exceeded the life span in the comparative example, while 80 bars were lapped in the example, and it was confirmed that the lifetime of the lapping plate was prolonged.

Although a certain preferred embodiment of the present invention has been shown and described in detail, it should be understood that various changes and modifications may be made without departing from the spirit or scope of the appended claims.

What is claimed is:

1. An apparatus for lapping a slider, comprising:

a lapping head for supporting elements to be formed into sliders as said elements are pressed against a rotating lapping plate;

a holding mechanism for supporting said lapping head, said holding mechanism having a first engaging member that extends in a vertical direction;

a base for supporting said holding mechanism, said base having a second engaging member that extends in the vertical direction, wherein said second engaging member is engaged with said first engaging member to form an internal space therebetween; and a decompressing mechanism for decompressing said internal space, thereby forming a decompressed internal space, wherein said holding mechanism is subjected to vertically upward force from the decompressed internal space in order to be movably supported by said base in the vertical direction.

2. The apparatus according to claim 1, wherein said first engaging member is a cylinder provided in said holding mechanism, and said second engaging member is a piston provided in said base.

3. The apparatus according to claim 1, wherein said first engaging member is a piston provided in said holding mechanism, and said second engaging member is a cylinder provided in said base.

4. The apparatus according to claim 1, wherein said base includes a fixed frame member for supporting said lapping plate, and a guide member having said second engaging member, said guide member being movable in the vertical direction relative to said frame member, and either said frame member or said guide member has a ball screw, and the other has a nut adapted to be engaged with said ball screw.

5. The apparatus according to claim 4, wherein said guide member has a first engaging section which extends in the vertical direction, and said holding mechanism has a second engaging section which is engaged with said first engaging section and which only moves in the vertical direction relative to said guide member.

6. The apparatus according to claim 1, wherein said lapping head includes:

a plurality of pushers which are provided at positions that correspond to said elements, respectively, said pushers being adapted to individually control pressing forces against said lapping plate; and a pusher supporting section to support said pushers, said pusher supporting section being mounted fixedly at least in the vertical direction relative to said holding mechanism.

7. A method for lapping a slider, comprising the steps of:

preparing a lapping apparatus which includes a lapping head for holding elements that are to be formed into sliders, a holding mechanism for supporting said lapping head, and a base for supporting said holding mechanism, wherein said holding mechanism has a first engaging member that extends in a vertical direction, said base has a second engaging member that extends in the vertical direction, wherein said second engaging member is engaged with said first engaging member to form an internal space therebetween;

holding said elements by means of said lapping head such that said elements face said lapping plate; and lapping said elements by pressing said elements against the rotating lapping plate in a state in which said holding mechanism is supported movably in the vertical direction by said base, wherein said state is obtained by decompressing said internal space so that said holding mechanism is subjected to vertically upward force from the decompressed internal space.

8. The method according to claim 7, wherein the step of lapping includes simultaneously lapping said elements while individually controlling pressing forces against said lapping plate, said pressing forces being applied at positions that correspond to the respective elements.

9. The method according to claim 8, wherein the pressing forces are applied by pushers, and wherein controlling the pressing forces applied by said pushers includes controlling vertical strokes of said pushers.

10. The method according to claim 7, further comprising an element height forming lapping step to form a read element height of said element prior to the steps of holding said elements and lapping said elements, wherein the step of lapping said elements includes lapping resistance elements simultaneously with said elements that are to be formed into said sliders while monitoring electric resistance of said resistance elements, wherein said resistance elements are provided adjacent to said elements on a lapping surface.

11. The method according to claim 10, wherein the step of lapping said elements is completed when the electric resistance of said resistance elements reaches a target value of the electric resistance, said target value is predetermined based on a relationship between the lapping amount of said resistance element and the electric resistance thereof.

* * * * *